US006836635B2

(12) United States Patent
Metzler et al.

(10) Patent No.: US 6,836,635 B2
(45) Date of Patent: Dec. 28, 2004

(54) METHOD AND CONTROL DEVICE FOR PREVENTING REGISTER ERRORS

(75) Inventors: Patrick Metzler, St. Wendel (DE); Stefan Schrader, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/360,284

(22) Filed: Feb. 7, 2003

(65) Prior Publication Data

US 2004/0086304 A1 May 6, 2004

(30) Foreign Application Priority Data

Feb. 27, 2002 (DE) ..... 102 08 597

(51) Int. Cl.[7] ..... G03G 15/01
(52) U.S. Cl. ..... 399/301
(58) Field of Search ..... 101/182, 211; 347/116; 358/1.1, 1.18; 399/299, 301

(56) References Cited

U.S. PATENT DOCUMENTS 5,287,162 A 2/1994 De Jong et al.
6,493,012 B2 * 12/2002 Buch et al. ..... 347/116
2002/0050219 A1 5/2002 Hunold et al.
2003/0029341 A1 2/2003 Metzler

FOREIGN PATENT DOCUMENTS

| | | | |
|---|---|---|---|
| DE | 199 34 658 A1 | 1/2001 | ..... G03G/15/16 |
| EP | 0 291 738 A1 | 4/1988 | ..... G03G/15/00 |
| EP | 0 859 288 A1 | 2/1997 | ..... G03G/15/00 |
| EP | 0 821 283 A1 | 7/1997 | ..... G03G/15/00 |
| EP | 1 157 837 A2 | 11/2001 | ..... B41F/33/00 |

* cited by examiner

*Primary Examiner*—Hoang Ngo
(74) *Attorney, Agent, or Firm*—Lawrence P. Kessler

(57) ABSTRACT

Printers wherein a snub pulley gripping the conveyor belt from below changes contact force, a first register error occurs; and due to change of the spacing between the image lines on the sheet change, a second register error occurs. To prevent the first register error, time-lags of the first start signals (START OF FRAME) for the application of image lines are changed; and to prevent a second register error, time-lags of the second start signals (START OF LINE) for the application of image frames are changed.

6 Claims, 3 Drawing Sheets

METHOD AND CONTROL DEVICE FOR PREVENTING REGISTER ERRORS

FIELD OF THE INVENTION

This invention relates in general to a method and control device for preventing register errors caused by variable contact forces of a pulley gripping a conveyor belt.

BACKGROUND OF THE INVENTION

When printing stock, for example, a sheet of paper or similar material, by printers, the correctly positioned printing of the print image on the stock is of considerable importance. This characteristic is designated by the term registerability. To ensure the registerability, register marks are used outside the printing image, by which deviations from the correctly positioned printing are captured and measured by the operator of the printer. With further development of this method, the registerability is determined by sensors in the printer and a possible register error calculated. To this end, the sensors detect the register marks on the conveyor belt or stock and use the position of the register marks to determine whether the printing is taking place flawlessly or not.

The method and devices of the state-of-the-art technology capture and correct register errors, which are caused, for example, by mechanical shifting of the stock on the conveyor belt, by changes in speed of the conveyor belt or the printing drum, or by changes in the thermal surface on the impression drum and the resulting transmission errors between the illustration drum and the printing drum. The paths traveled by the conveyor belt carrying the stock, according to which the image is applied to the stock, are, however, determined by a certain time-lag that elapses during the movement of the stock onto the conveyor belt between a sensor signal, or a signal derived therefrom at the beginning of the printing module of the printer, and a printing gap or nip on a printing module, which applies the image to the stock. Likewise, the image path traveled from the illustration device, during which a latent electrostatic image is applied to an illustration drum, to the printing gap or nip between the printing drum and the conveyor belt, is determined by a specified time. Due to the previously described influences, the preset time lags specified in one control device of the printer are erroneous. The printing image, due to the existence of the changes to the printing drum in the printing module is applied to the stock in a shifted position. This leads to a register error.

Another reason for the register error is due to the fact that the contact force of the snub pulley affects the rotational velocity of the printing drum on the opposite side of the conveyor belt. If an intermediate drum is used, which is attached by friction to the printing drum, the rotational velocity of the printing drum is correspondingly affected. As a result of the effect of the rotational velocity of the printing drum, the time lag at which an image frame or frame of the printing drum is applied to the stock is changed. For example, an image frame or frame is delayed on the stock, if the rotational velocity of the printing drum is reduced. Another reason for register errors is the pressing of a snub pulley gripping the conveyor belt below into the printing gap or nip, which, as a result of the variable contact force, changes, as described below. The snub pulley provides a counterforce to the printing drum above the conveyor belt. The forces of the printing drum on the stock or conveyor belt is required to mechanically transfer the toner from the printing drum onto the stock and to transfer the toner image subsequently. Furthermore, the toner image, which consists of register marks in this case, are sometimes transferred to the conveyor belt, as in the case of the calibration run of the printer. The contact force of the printing drum has an affect on the resolution of the image lines that compose an image. The higher the contact force of the printing drum, the further the image lines move apart, as described in detail below. In the printing gap, or nip, errors are incurred by the distance of the image lines from one another. Both of the last-named effects are designated and considered as the first register error and as the second register error in the existing description.

SUMMARY OF THE INVENTION

It is the purpose of this invention to correct register errors caused by variable contact forces of a snub pulley. According to the invention, the register errors are caused by the variable contact force of a snub pulley gripping the conveyor belt, and to prevent a first register error, the time-lags of the first start signals (START OF FRAME) for the application of images or frame are changed and to prevent a second register error by two start signals (START OF THE LINE), time-lags for the application of image lines are changed. Furthermore, an illustration device is provided for the transfer of image lines to a printing drum, with a first sensor for detecting a stock in front of the printing modules, a second sensor to detect the register marks behind the printing modules, a rotary encoder to capture the rotation angle of an illustration drum and a device to store the values of the first start signals (START OF FRAME) for the application of image frames or frames and of second start signals (START OF LINE) for the application of image lines, which are determined by the variable contact force of a snub pulley gripping the conveyor belt.

In a particularly advantageous manner, the start signals are adjusted to the case if stock is located between the printing drum and the conveyor belt. In this case, the contact force of the printing drum and consequently the register error change in particularly forceful ways. Furthermore, the start signals may be related to the properties of a stock. In this manner, the distinct change of the image line definition, i.e., the distance of the image lines on the stock from one another, variable contact forces are taken into consideration with different stock. The contact force of the snub pulley thus increases constantly if the snub pulley is shifted. In this case, increasing forces of the pneumatic position of the snub pulley work against such force. For example, a variable contact force of the snub pulley has less of an effect with a strongly compromised stock than with a slightly compromising stock, since the snub pulley is not so strongly deflected as with a slightly compromising stock. The greater the deflection of the snub pulley, the greater the contact force. With a strongly comprising stock, the image lines do not move as far apart as with a slightly compromising stock, if the contact force of the snub pulley and consequently the force of the printing drum on the stock increases. The contact force of the snub pulley depends upon the contact force of the printing drum, since the snub pulley is arranged opposite the printing drum, whose forces work against one another. In addition, the thickness of the stock is taken into consideration, which affects the contact force of the snub pulley, since the contact force is proportional to the path to which the snub pulley is shifted due to the stock in the printing gap or nip.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1A:
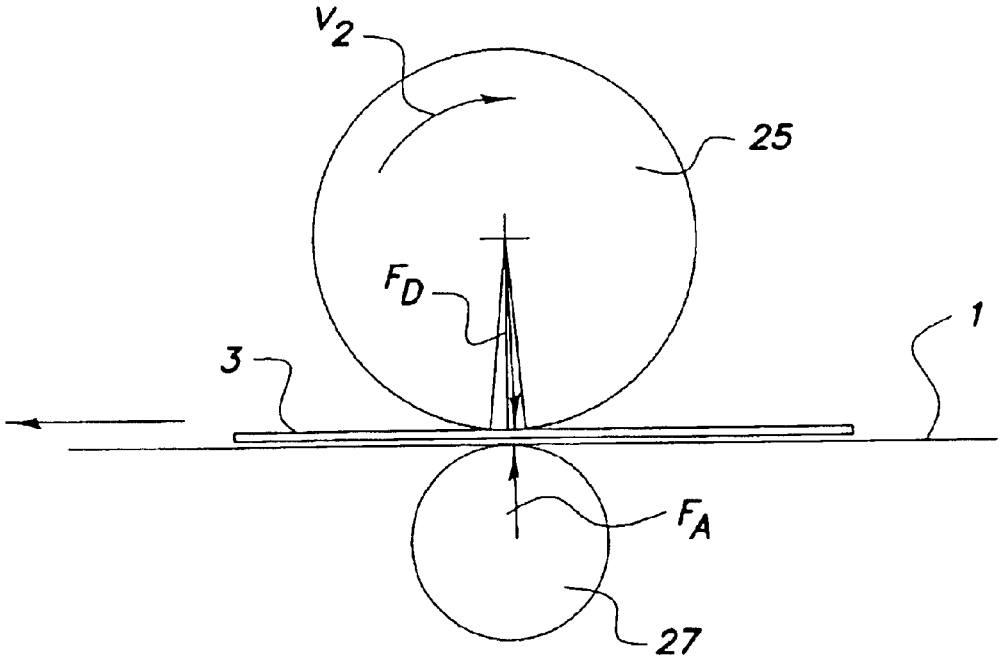
FIGS. 1*a* and 1*b* each show a schematic view of a section of a conveyor belt with a printing module above the conveyor belt and a snub pulley below the conveyor belt for clarification of the principle of the second register error.
Figure 3:
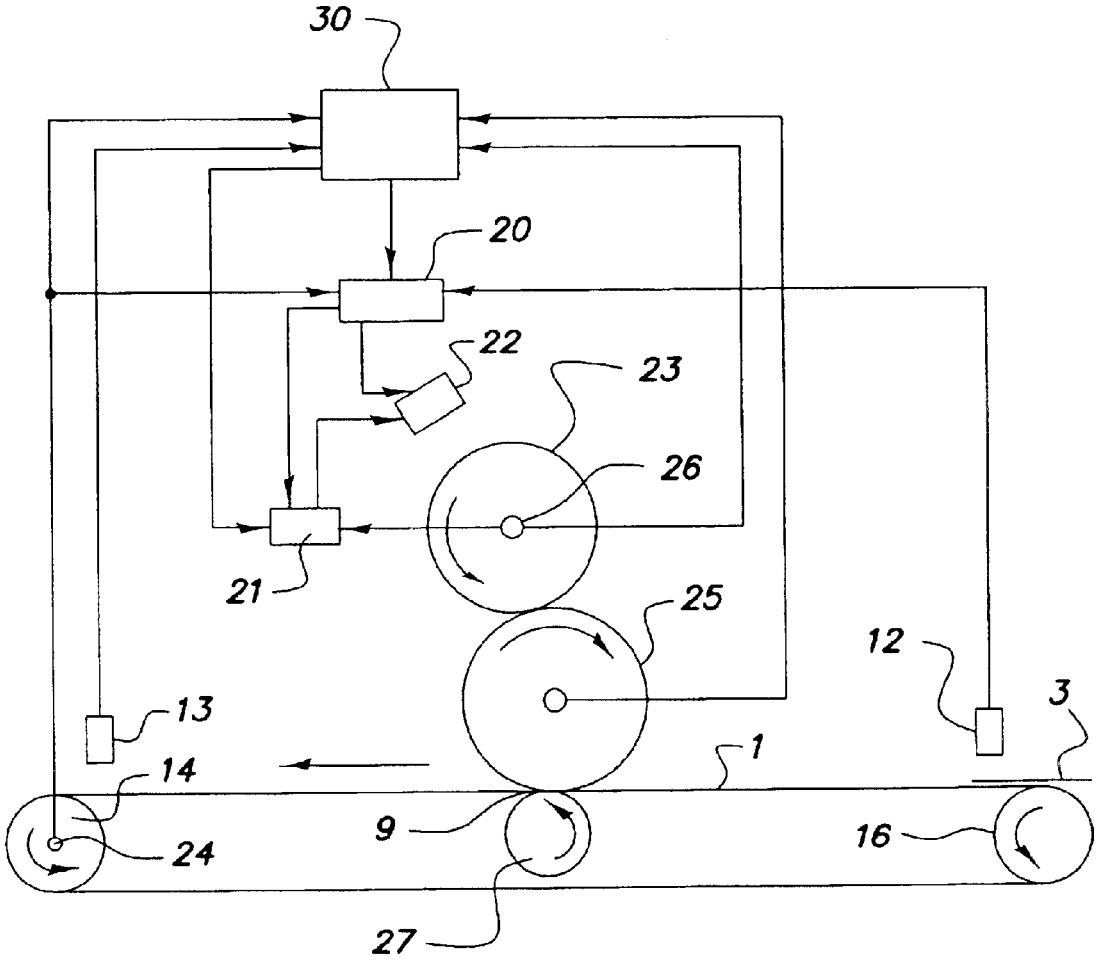
FIG. 3 shows a schematic view of a printing module of a printer as an embodiment of the invention.

FIG. 1*a* shows a schematic view of a section of a conveyor belt 1. Subsequently, a calibration run of a printer for calibrating printing registers is described. As shown in FIG. 3, the conveyor belt 1 is continuously stretched around the return pulley 14, 16. A printing drum 25 is an intermediate drum in this example, which receives the image of an illustration drum 23, which is transferred to a stock 3. The printing drum 25 can also apply the image directly. The printing drum 25 exerts a force FD from the top on the conveyor belt 1, such as illustrated in FIG. 1*a* by the force arrow. A snub pulley 27 exerts one of the forces from below against set forces on the conveyor belt. The snub pulley 27 is pneumatically positioned and exerts a constant force FA on the conveyor belt 1 under ideal conditions in FIGS. 1*a*, 1*b*, but the contact pressure of the snub pulley 27 does not change in this case. In this example, the snub pulley 27 slips into a printing gap or nip 9 with the entry of the stock 3, without the contact force of the printing drum 25 on the conveyor belt changing. The conveyor belt 1 is driven by a motor, which is moved with a specific speed in the direction of the arrow and moves the printing drum 25 and the snub pulley 27 by friction. The three lines, which run in the printing drum 25 from the axis to the circumference of the printing drum 25 symbolically clarify the distances between the image lines and are illustrated to clarify how far apart they are from one another. An image line is printed on the stock 3 respectively at the interface of the three lines with the circumference of the printing drum 25. The distances between the image lines in FIG. 1*a* are ideal and without register errors. The influences of variable contact forces of the snub pulley 27 have no effect in FIG. 1*a*.

Figure 1B:
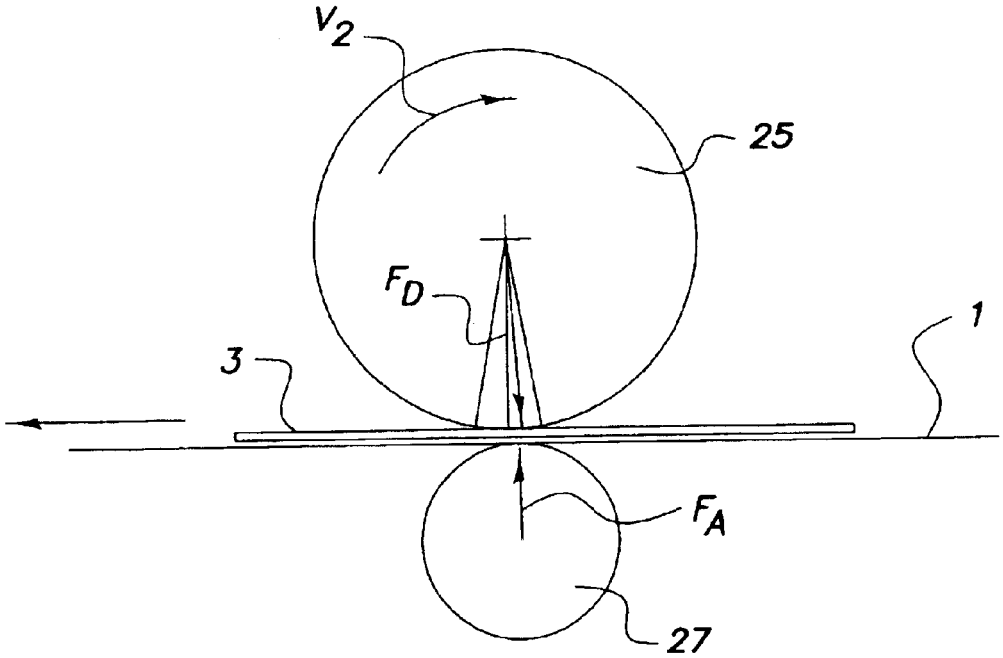

FIG. 1*b* shows an illustration similar to FIG. 1*a* with the affect of a second register error. This shows the real instance in which the contact pressure of the snub pulley 27 is variable. The less compressible the stock 3, the more the snub pulley 27 is displaced and the higher the contact pressure and second register error as a result of a non-ideal pneumatic position of the snub pulley 27. The three lines in the printing drum 25 are far part. Consequently, the image lines on the stock 3 are further apart compared to FIG. 1*a*; the resolution of the image lines has changed. When the three image lines are printed on the stock 3, the three image lines on the stock are further apart from one another. In the illustration according to FIG. 1*b*, it is assumed that the rotational velocity $V_2$ of the printing drum 25 is, for example, constant. This assumption is not achieved in operation, since the rotational velocity of the printing drum 25 changes depending on the contact force of the snub pulley 27; however, this has no affect on the resolution of the image lines.

The second register error, a changed resolution of the image lines, is caused by the increase of the contact force coming from the snub pulley 27 due to a deflection of the compressible stock 3. On the other hand, the stock 3 expands for the same reasons, whereby this expansion contributes less to the illustrated effect than the increasing contact force. In FIG. 1*b*, the influence of other contact forces of the snub pulley 27 has an affect and causes a second register error. This effect occurs all the more strongly if a sheet 3 enters into the nip 9 and with the out-of-trueness of the printing drum 25 or the snub pulley 27. As a result, the printing image is distorted. The change in the resolution of the image lines, i.e., the distances of the image lines from one another, can be determined by measuring of the register marks as well the rotation angle of the illustration drum 23.

Figure 2A:
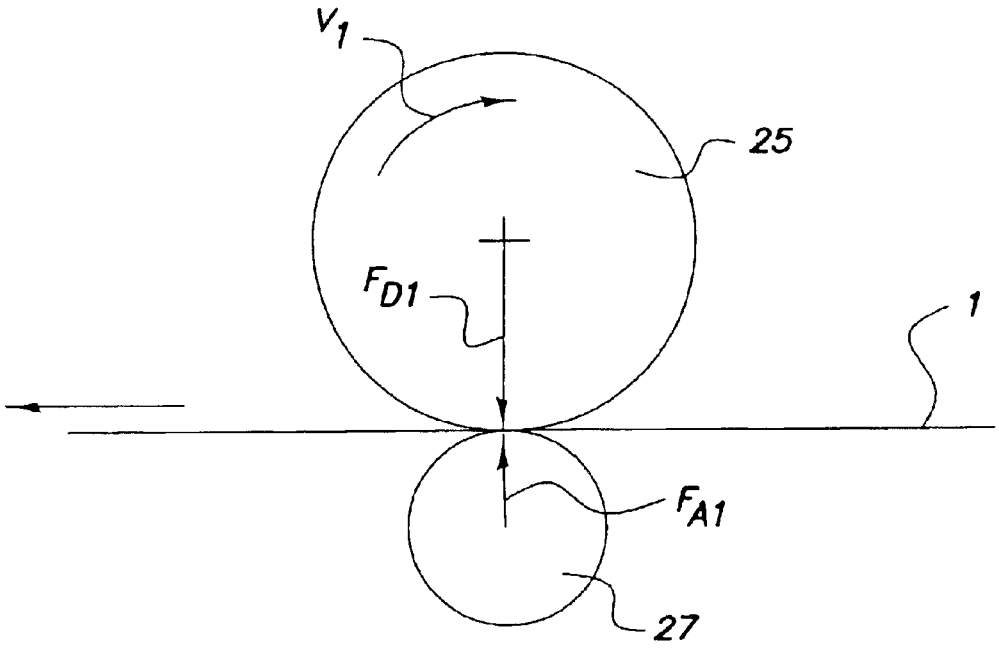
FIG. 2 shows a schematic view of a section of a conveyor belt with a printing drum above the conveyor belt and a snub pulley below the conveyor belt for clarification of the acting forces without stock.
FIG. 2*b* shows a schematic view of a section of a conveyor belt with a printing drum above the conveyor belt and a snub pulley below the conveyor belt to clarify the acting forces with stock.

FIG. 2*a* shows a schematic view of a section of a conveyor belt 1. The conveyor belt 1 is continuously stretched around the deflection pulley 14, 16. In this example, the printing drum 25 is an intermediate drum, which obtains the image from an illustration drum 23 and transfers it to a stock 3 or the conveyor belt 1. In FIG. 2*a* there is no stock in the printing gap or nip 9 between the printing drum 25 and the conveyor belt 1, the nip 9. The printing drum 25 exerts a force FD1 from above on the conveyor belt 1, as illustrated by the force arrows. A snub pulley 27 exerts one of the forces from below on the conveyor belt 1 of the printer. The snub pulley 27 is pneumatically positioned and exerts a variable force FA1 on the conveyor belt 1. The snub pulley 27 deflects to a certain degree as the force FD1 of the printing drum 25 rises, yet the contact pressure of the printing drum 25 varies on the conveyor belt 1. The conveyor belt 1 is driven by a motor, moving with a specific speed in the direction of the arrow, moving the printing drum 25 and the snub pulley 27 by friction. In FIG. 2*a*, the printing drum 25 has a speed $V_1$. It should be noted that the speed $V_1$ of the printing drum 25 with the contact pressure exerted by the forces FD1 and FA1 changes. The higher the contact pressure, the more the rotational velocity of the printing drum 25 is reduced. A change in the rotational velocity of the printing drum 25 affects the register-containing application of the image and leads to errors in the register-containing transfers of an image frame or frames, which is applied at the wrong time. The term image frame or frame in the case of a calibration run designates a frame of register marks, which are applied by the various printing modules of the printer. In the case of a multicolor printer, the frame contains, for example, the register marks for the colors cyan, magenta, yellow and black, which are applied to the stock 3 or the conveyor belt 1. During the printing process, the image frame or frame contains all the image information on a color for the stock 3 to be printed. The erroneous transfer of the image frame or frame to the stock 3 or to the conveyor belt 1 is indicated in the above-mentioned description as the first register error. With the transfer of a register mark on conveyor belt 1, for example, during a calibration run of the printer, the errors of the image frame or frame caused by the above-mentioned effects can be proven by measuring the shifting of the register marks in comparison with the flawless position of the register marks.

Figure 2B:
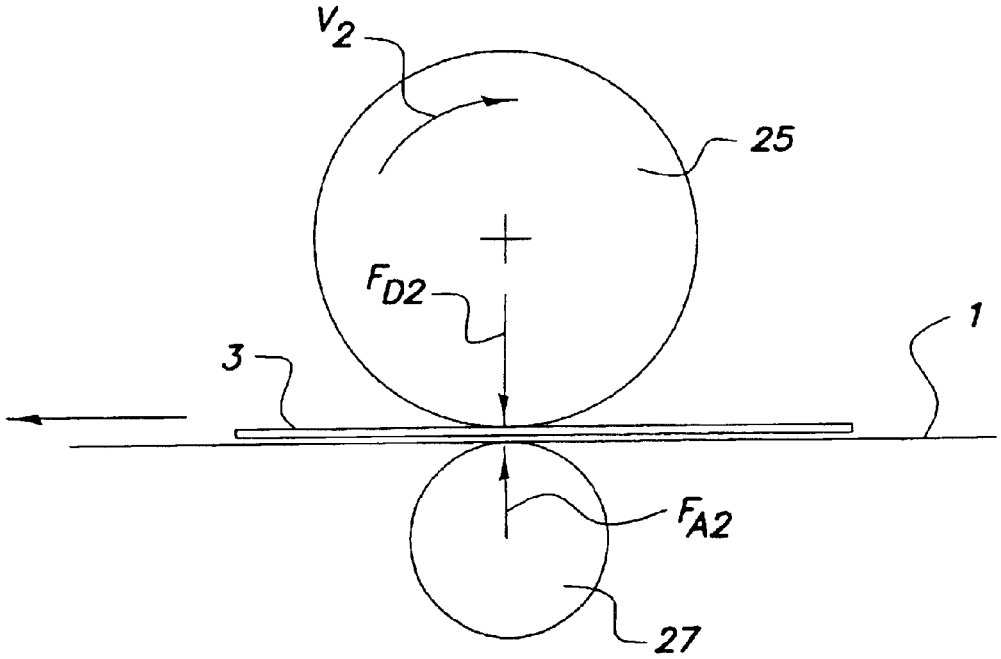

FIG. 2*b* shows an illustration similar to FIG. 2*a*. On the conveyor belt 1 between the printing drum 25 and the conveyor belt 1 lies stock 3, a sheet of paper in this case, which is conveyed by the conveyor belt 1. Generally speaking, a small portion of the stock 3 is secured to the conveyor belt 1 by the force of its own weight, and larger portions are secured by an electrostatic charging of the conveyor belt 1. The thickness of the stock 3 also affects the contact pressure of the conveyor belt 1. The force from the printing drum 25 affecting the stock 3 is now, due to the stock 3, equal to FD2 and unequal to FD1, by otherwise similar conditions as in FIG. 2*a*. The force affecting the conveyor belt 1 by the snub pulley 27 from below is now, due to the stock 3, equal to FA2 and unequal to FA1. Due to the pneumatic position of the snub pulley 27, the effects on the registerable printing are partially, although not completely, cleared.

Assuming that the pneumatic position of the snub pulley 27 is working ideally, the contact force of the snub pulley 27 does not increase as a result of the stock 3. However, an ideal pneumatic position of the snub pulley 27 can only be produced at a considerable cost. Hence the first register error and the second register error occur. In FIG. 2*b*, the rotational velocity $V_2$ of the printing drum 25 changes to $V_2$, which is not equal to $V_1$ according to FIG. 2*a*, in which the stock 3 has no affect. The changed rotational velocity $V_2$ causes the first register error, which is increased with the expanding thickness of the stock 3 in the printing gap or nip 9. With respect to the first register error, the changed rotational velocity $V_2$ only affects a sheet 3 on the conveyor belt 1 subsequent to the real sheet 3 in the nip 9. With respect to the second register error, the changed contact force already affects the real sheet 3 in nip 9 on the conveyor belt 1.

It is assumed that the time lag of the printing of the stock 3 is adjusted by the printing drum 25 above the stock 3 to a specific speed of the printing drum 25. This means that the illustration of an illustration drum 23 or of the conveyor belt 1 is performed by an illustration device 22 with a time-lag so that the illustration drum 23 or the printing drum 25 transfers the toner-filled image with a predetermined adjusted rotational velocity $V_1$ precisely with the desired time-lag in the interval between the stock 3 and the illustration drum 23 or printing drum 25 to nip 9. Since the rotational velocity $V_2$, due to the variable contact pressures of the printing drum 25 and the snub pulley 27 FD1 and FA1 are not equal to FD2 and FA2, if is not equal to the adjusted rotational velocity $V_1$, such that the printing on the surface of the stock 3 or conveyor belt 1 does not take place at the proper time, but is delayed on the path, which is less traveled by the printing drum 25 due to the rotational velocity difference $V_2$_$V_1$. This means that the greater the deviation of the rotational velocity $V_2$ of the printing drum 25 to an adjusted rotational velocity, the greater the shifting of the printing image on the stock 3. Care must be taken that the rotational velocity change of the printing drum 25 does not only occur due to the described affect of a stock 3, but also due to other influences, for example, temperature changes and the resulting environmental changes of the printing drum 25.

FIG. 3 shows a schematic side view of a printing module of a printer with the continuous conveyor belt 1, which is stretched around a first deflection roller 16 and a second deflection roller 14, which moves from there in the direction of the arrows. Underneath the conveyor belt 1, the snub pulley 27 is arranged, with a contact force from below the conveyor belt 1 and which provides a counterforce to a contact force of the printing drum 25. In this example, the printing drum 25 is an intermediate drum that contains the toner-filled image of an illustration drum 23, which is loaded with the toner-filled image by an illustration device 22. The illustration device 22 contains the devices required for this procedure: a device for the electrostatic loading of the photo-conducting surface of the illustration drum 23, a controlled light source, for example, an LED array, which loads the photo-conducting surface of the illustration drum 23 with a latent electrostatic image, which is dyed with toner by a developing device and which results in an image to be printed, as well as cleaning devices to remove the excess toner once the image has been transferred to the stock 3 and for the renewed illustrations of the illustration drum 23. The second deflection roller 14 is attached to a first rotary encoder 24 and a second rotary encoder 26 is attached to the illustration drum 23. The first rotary encoder 24 and the second rotary encoder 26 capture the rotation angle of the second deflection roller and of the illustration drum 23 in specific short intervals. The first rotary encoder 24 sends signals regarding the rotation angle of the second deflection roller 14 to the pulse counter 20 and to the device 30. The rotation angle of the second deflection roller 14 is thus available in the device 30 and in the pulse counter 20. Connected with the illustration device 22 is a pulse counter 20, which is connected with a device 30, with a first sensor 12 in front of the printing modules of the printer, with a pulse divider 21 and with the first rotary encoder 24. A second sensor 13 behind the printing modules of the printer is connected with the device 30. The pulse divider 21 is furthermore connected with the device 30, with the illustration device 22 and with the second rotary encoder 26 on the illustration drum 23.

In the above-mentioned description, a calibration run is described. In a calibration run, the first sensor 12 in front of the printing modules of the printer detects the front edge of a stock 3, which is conveyed on the conveyor belt 1. The first sensor 12 transfers a signal, also a lead edge signal to the pulse counter 20 in reaction to the detection of the front edge of the stock 3. Following the sequence of a certain number of pulses, a first start signal, the START OF FRAME signal is generated, which is used to release the illustration by the illustration device 22 precisely at the right time, with the releasing of the START OF FRAME signal, so that an image frame or frame is transferred at the proper time onto the illustration drum 23 and lastly onto the stock 3—or which is also transferred to the conveyor belt 1 for the purpose of the calibration described herein.

The term image frame or frame indicates a frame of register marks during a calibration run that are applied by the various printing modules of the printer. With a four-color printer, the frame contains, for example, the register marks for the colors cyan, magenta, yellow and black, which are applied by the corresponding printing modules to the stock 3 or the conveyor belt 1. An image frame or frame can have, in addition to the special sections of the calibration described herein, a number of register marks for the individual colors.

In the printing process, the frame or the image frame can contain all the image information for the stock 3 to be printed, for a color; for example, cyan, magenta, yellow and black. In addition, a second start signal, the START OF THE LINE signal is generated, which releases the illustration of several lines perpendicular to the progressive movement direction of the stock 3 by the illustration device 22. At the START OF THE LINE signal, an image line is written on the illustration drum 23, with a first image line at the beginning of the beginning of the frame, successive image lines and a last image line at the end of the frame. The START OF THE LINE SIGNAL is generated by pulse division, with a division factor from the device 30 in the pulse divider 21. The pulse divider 23 contains data from the second rotary encoder 26 regarding the rotation angle of the illustration drum 23 and divides these data according to the division factor.

By the START OF LINE signal produced by pulse division, it is determined at what distance from one another the image lines are to be transferred from the illustration device 22 to the illustration drum 23. Following the detection of the front edge of the stock 3, the stock is further conveyed via the conveyor belt 1. During the calibration run described herein, the image frames or frames with the individual register marks are applied by the respective printing modules to the conveyor belt 1 and to the stock 3. To this end, the register marks are transferred from the illustration device 22 to the illustration drum 23 and from there to the printing drum 25. The transfer of the register marks to the conveyor belt 1 or stock 3 takes place in the nip or printing gap 9, in the area between the printing drum 25 and the conveyor belt 1, whereby the snub pulley 27 presses against this from underneath the conveyor belt 1, providing a counterforce to the contact pressure of the printing drum 25.

After the register marks have been applied to the conveyor belt 1 or the stock 3, they are detected behind the printing modules by the second sensor 13, also known as the register sensor. The second sensor 13 hereby detects the light/dark transfer between the respective register marks and the background of these register marks, the conveyor belt 1 or stock 3. The second sensor 13 transfers a signal to the device 30 in reaction to the capture of the individual register marks. In addition, the rotation angle of the rotary encoder 26 is transferred to the device 30, which is measured at the time of the START OF FRAME. The device 30 contains variable and constant data with respect to the START OF FRAME signal and the START OF LINE signal, which are to the pulse counter 20 and to the pulse divider 21, and the illustration of the image frames or frames and the image lines are released at the appropriate time by the illustration device 22. The constant data of the device 30 indicate the set point at which the illustration is released by the illustration device 22 without outside influences and error affects. The variable data take into account changes during the calibration run, that indicate that the illustration has errors. The variable data for correcting the affect of the variable contact force of the snub pulley 27 are generated from the data of the second sensor 13 and the second rotary encoder 26 on the illustration drum 23. The corresponding dimensions without error effects generate the constant data of the device 30, which are ideal data. The variable dimensions contain deviations and errors from the ideal data and generate the various data of the device 30.

The variable data are determined by the calibration run of the printer, in which the error effects are determined on the basis of deviations of the register marks over time. Error effects include temperature influences on the illustration drum 23, particularly on the printing drum 25, which, lead to circumference changes. In addition, error effects include out-of-trueness errors of the printing drum 25 or of the illustration drum 23, which results in a periodic change of the path lengths for the individual image lines of the illustration device 22 up to nip 9. The addition of the variable and the constant data on the one hand results in the time-lag data of the device 30, that are transferred to the pulse counter 20 which counts the pulse counts corresponding to these time-lag data, according to which a release signal or start signal is sent to the illustration device 22 to apply an image to the illustration drum 23, which is the first signal or START OF FRAME signal.

Pulse counts are assigned at this point to the time-lag data. The pulse counter 20 counts a number of pulses that are determined by the time lag data, after which a START OF FRAME signal is immediately generated. On the other hand, there are division factors that are transferred to the pulse divider 21, which begin with the generation of the START OF LINE signal, which is released by the START OF FRAME signal. The START OF LINE signals are generated by the division of pulses of the rotary encoder 26 by the division factors. With the START OF FRAME signal, the illustration of a frame is released, and with the START OF LINE signal, the illustration of an image line is released. In order to achieve registerable printing, the lower the pulse counts of the pulse counter 20 assigned to the time-lag data, the higher the rotational velocity change of the printing drum 25 caused by the contact pressure and the illustration drum 23 connected to the printing drum by friction, such that the corresponding pulse count is the first start signal, and the START OF FRAME signal is released earlier, since the rotational velocity change affects the proper register application of the image frames or frames. The image frame or frame reaches the nip 9 at the proper time with the aid of the above-mentioned described characteristics and does not reach the nip 9 too late due to the lower rotational velocity of the printing drum 25.

This first register error, also called the time-lag error, is measured during the calibration run of the second sensor 13 or register sensor. The pulse counts of the pulse divider 21 assigned to the divider factor data of the device 30 are required for registerable printing to be kept in a register, whereby the lower they are, the higher the expansion of the coating of the rubber blanket of the printing drum 25, compare with FIGS. 1*a*, 1*b*. This second register error, also known as a magnification error, is determined during the calibration run by measuring the register marks by a second sensor 13 or register sensor, as well as by the measuring of the rotation angle by the rotary encoder 26 and subsequent calculation from the measuring data received. In order to determine the resolution of the image lines caused by the expansion of the coating of the rubber blanket, the pulse count by the pulse divider 21 is reduced. With the reduction of the pulse count due to a higher contact pressure, following which the second start signal, the START OF LINE signal is generated, the image lines move together around the amount, around which these were spread apart due to the expansion of the coating of the rubber blanket, i.e. the image lines move closer together and the second register error is corrected.

In summary, the constant data in the device 30 are not precise enough to provide registerable printing. The pulse count, following which the START OF FRAME signal is generated, is thus composed of constant data as well as variable data. With the aid of the variable data, affects on the registerability, for example, rotational velocity changes of the printing drum 25 or also out-of-trueness of the printing drum 25 and of the illustration drum 23 are corrected, the first register error and second register error. The variable data are related to the sensor data of the second sensor 13 or to the rotation angles of the second deflection roller 14, to the illustration drum 23 and to the printing drum 25. The division factors of the device 30 delivered to the pulse counter 21, according to which rotation angles of the illustration drum 23 the START OF LINE signals are generated, are likewise composed of a variable portion and a constant portion, similar to the time-lag data. The variable part, including the time-lag data and the division factors are related to the contact pressure.

A higher contact pressure of the snub pulley 27 and consequently of the printing drum 25 causes both a shifting of the image frames or frames as well as image lines of the printing image that are further apart; the printing image expands and has a greater linear expansion. A stock 3 between the printing drum 25 and the conveyor belt 1 strengthens the effect of a variable contact pressure, which is further strengthened by the increasing thickness of the stock. Various thicknesses of stock 3 consequently cause different first register errors and second register errors.

With some variants of the invention, the thickness of the stock 3 is used as a part of the variable data in the device 30. The variable data concerning the thickness of the stock 3 are stored in the device 30 prior to the printing process, i.e. after the calibration run, and are thus available. Another possibility is, that the variable data are determined in relationship to the thickness of the stock 3 during a calibration run, whereby the variable data are calculated from the rotational velocity difference from $V_1$, without stock 3 in the nip 9 and $V_2$ with stock 3 in the nip 9.

Furthermore, the releasing of adjacent image lines is affected by the composition of the stock 3. With less compressible cardboard, the distances between adjacent lines are, for example, increased in comparison to soft compressible paper. The composition of stock 3 is thus used in the corresponding way as the thickness of the stock 3 as a part for the time-lag data, which determine time-lags for the first start signal, the START OF FRAME signal and for the second start signal, the START OF LINE signal. The previously described individual portions, the portion concerning the thickness and composition of the stock 3, and the constant and variable data are added and provide the time-lag data for the device 30. The time-lag data provide a pulse count, which is counted into the pulse counter 20, and the illustration, released by the first start signal and the second start signal, is induced at another time than originally planned, to the extent that error effects are present.

A concrete calibration run to calibrate the first register errors or time-lag errors is described as follows. The conveyor belt 1 is first operated in a first calibration run without sheet 3 and the first register error is determined as described. The conveyor belt 1 is then operated in a second calibration run with several successive sheets 3. In this case, the frames are between the sheets 3. The contact force of the snub pulley 27 is changed due to the effect of the sheets 3, and the frames, which contain the register marks, are shifted. This shifting of the frames, which corresponds to the first register error, is measured by a second sensor 13. Subsequently, the conveyor belt 1 is operated in a third calibration run is again operated without sheets 3 and the first register error is measured. The first register error in the situation without sheets 3 on the conveyor belt 1 is determined by both the first and third calibration run. A consistent rise or fall of the first register error via the same calibration run, due, for example, to a thermal draft, can thus be removed by determining a mathematical average. Both first register errors determined with and without sheets 3 on the conveyor belt 1 were subsequently compared.

A concrete calibration run to calibrate second register errors or magnification errors is described as follows. The above-described calibration run can be used for the first register error, if frames with register marks are also printed on the sheets 3. On one, the release of the image lines on the sheets 3 are measured; on the other, the release of the image lines on the conveyor belt 1 were measured. Signals of the second sensor 13, of the first rotary encoder 24 and of the second rotary encoder 26 are used for this purpose. Subsequently, the measured second register error on the conveyor belt 1 and on sheet 3 were compared. From the difference in the comparison, the variable data were calculated. In the above-described way, the effect of a variable contact force of a snub pulley 27 on registerable printing is reliably corrected.

The invention has been described in detail with particular reference to certain preferred embodiments thereof, but it will be understood that variations and modifications can be effected within the spirit and scope of the invention.

What is claimed is:

1. Method to prevent register errors in printers, such register errors being caused by a variable contact force of a snub pulley (27) gripping a conveyor belt (1) forming a print stack (3) transport nip with a printing drum (25), the method comprising: changing time-lags for a first START OF FRAME signal for application of image frames to prevent a first register error; and, changing time-lags of second START OF LINE signals, in corresponding relation to the variable contact force of a snub pulley in the transport nip, for the application of image lines to prevent a second register error.

2. Method according to claim 1, wherein print stack (3) is detected by a first sensor (12) in front of a plurality of printing modules of the printer; register marks are applied to the print stock (3) and to the conveyor belt (1) by the printing modules; register marks applied to print stock (3) are detected by a second sensor (13) behind the printing modules; a rotation angle of a printing drum (25) is captured by a rotary encoder (26); and a time lag for both START OF FRAME and START OF LINE signals are calculated from captured data and from constant data stored in a device (30).

3. Method according to claim 2, wherein in a first case, the time-lags of the START OF FRAME and START OF LINE signals are used, when the print stock (3) is situated between the printing drum (25) and the conveyor belt (1), and in a second case, other time-lags of the START OF FRAME and START OF LINE, signals are used when no print stock (3) is situated between the printing drum (25) and the conveyor belt (1).

4. Method according to claim 3, wherein the time lags of the START OF FRAME and START OF LINE signals are related to properties of a print stock (3).

5. In a printer having a plurality of printing modules including an illustration device (22) for transferring image lines to a printing drum (25) and thereafter to a print stock (3) transported by said conveyor belt and, a snub pulley (27) exerting variable force on a print stock conveyor belt (1), a control device (10) for preventing register errors comprising: a first sensor (12) for detecting a print stock (3) in front of said plurality of printing modules, a second sensor (13) for detecting register marks behind said printing modules, a rotary encoder (26) for capturing a rotation angle of said printing drum (25) and a device (30) for storing time-lags of first START OF FRAME signals for the application of image frames and of second START OF LINE signals for the application of image lines, which are determined by the variable contact force of said snub pulley (27) griping the conveyor belt (1).

6. Control device (10) according to claim 5, wherein said device (30) contains data relating to properties of print stock (3).

* * * * *